United States Patent [19]

Enomoto

[11] 4,135,486

[45] Jan. 23, 1979

[54] ARCHERY BOW STABILIZER

[76] Inventor: Kouichi Enomoto, 1295-3, Futatsugi Matsudo-shi, Chiba-ken, Japan

[21] Appl. No.: 734,968

[22] Filed: Oct. 22, 1976

[30] Foreign Application Priority Data

Sep. 20, 1976 [JP] Japan ..... 51-111799

[51] Int. Cl.[2] ..... F41B 5/00

[52] U.S. Cl. ..... 124/89

[58] Field of Search ..... 124/89, 88, 86, 23 R, 124/24 R, 80, 41 A

[56] References Cited

U.S. PATENT DOCUMENTS

| | | | |
|---|---|---|---|
| 3,196,860 | 7/1965 | Hoyt | 124/24 R |
| 3,412,725 | 11/1968 | Hoyt | 124/89 X |
| 3,468,297 | 9/1969 | Cress | 124/88 |
| 3,589,350 | 6/1971 | Hoyt | 124/24 R |
| 3,683,883 | 8/1972 | Izuta | 124/89 |
| 3,752,142 | 9/1973 | Morita et al. | 124/89 X |

OTHER PUBLICATIONS

"Accra-Lizer" -Archery Magazine, vol. 34, Aug. 1962.

*Primary Examiner*—Richard C. Pinkham
*Assistant Examiner*—William R. Browne
*Attorney, Agent, or Firm*—Ostrolenk, Faber, Gerb & Soffen

[57] ABSTRACT

An archery bow stabilizer is disclosed. A stabilizing weight element is supported on a first end of a support rod. A second end of the support rod is attached to a damper which is at least partially embedded in a centrally located handle of an archery bow. The damper has its center of gravity located within the area of the handle and includes means for resiliently supporting the second end of the support rod whereby the damper is permitted to follow minor vibrations in the bow substantially independently of the stabilizing effect of the weight element.

7 Claims, 3 Drawing Figures

ARCHERY BOW STABILIZER

BACKGROUND OF THE INVENTION

The present invention relates to an archery bow stabilizer, and more particularly relates to improved damper construction of archery bow stabilizer.

For the purpose of affording a stabilizing effect to archery bow shooting, it is conventional to provide an archery bow with at least one stabilizer which is disposed to the back face of the bow handle section and comprises a weight element, a support rod carrying the weight element at one end thereof and a damper upholding the other end of the support rod and disposed to the handle section while being located outside the body of the handle section.

With this construction of the conventional archery bow stabilizer, a relatively large mass moment of inertia acts on the archery bow due to the displaced positioning of the damper, i.e., positioning of the damper relatively remote from the longitudinal axis of the bow.

It is well known that, in the shooting condition, the shaft of an arrow is brought into pressure contact with the wall of the bow. Next, at the very moment of release, the arrow shaft presents a curved shaped, which curve is concave to the body of the bow. For a while during the initial stage of shooting, the arrow shaft alternately assumes both curves (i.e., concave and convex). This series of alternate behavior of arrow shafts is in general referred to as "archeries paradox".

During this archeries paradox, the arrow shaft advances, at the very moment of the release, in such a fashion as to repulse the body of the bow. Thus, in order to effectuate stable shooting of the arrow, it is strongly required that the bow be able to present delicate reaction neatly responsive to the initial behavior of the arrow at the very moment of the release.

In the case of the conventional stabilizer construction, the outside positioning of the damper results in a relatively large mass moment of inertia acting on the body of the bow, which more or less restrains the above-described delicate reaction of the bow in response to the above-described complicated initial behavior of the arrow at the very moment of the release.

It is also well known that the stabilizing effect by a stabilizer is controlled by the distance between the end weight element and the damper. Needless to say, the longer the distance, the larger the stabilizing effect. Provided that the entire distance between the end weight element and the longitudinal axis of the bow is fixed and constant, the outside positioning of the intermediate damper sets limits to the length of the distance between the intermediate damper and the end weight element, while controlling the stabilizing effect by the stabilizer.

OBJECTS OF THE INVENTION

It is the principal object of the present invention to provide an archery bow stabilizer which assures extremely delicate reaction of the bow in response to the initial behavior of arrows at the very moment of release.

It is another object of the present invention to provide an archery bow stabilizer accompanied with remarkably enhanced stabilizing effect.

BRIEF DESCRIPTION OF THE INVENTION

In accordance with the present invention, the damper carrying the support rod is at least partly embedded in the handle section of the bow.

BRIEF DESCRIPTION OF THE FIGURES

Further features and advantages of the present invention will be made clearer from the ensuing description, reference being made to the embodiment shown in the accompanying drawings, in which.

DETAILED DESCRIPTION OF THE INVENTION

Figure 1:
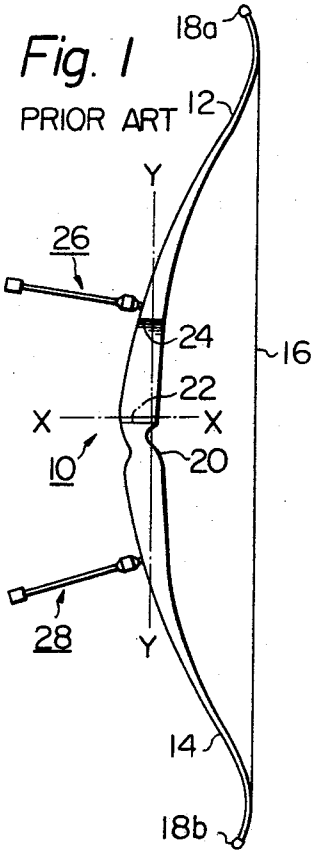
Fig. 1 PRIOR ART
FIG. 1 is a side elevational plan view of a typical example of the conventional archery bow provided with stabilizers.

Referring to FIG. 1, a typical conventional bow comprises a handle section generally indicated at 10 and upper and lower bow limbs 12 and 14, respectively. The handle section 10 has a front face facing a bow string 16 stretched between string hangers formed near upper and lower tips **18*a* and 18*b* and an opposite back face and is formed with a hand-gripping portion 20, an arrow seat 22 arranged just above the hand-gripping portion 20 and a sight window 24. The handle section 10 is inflexible in the sense that, under normal shooting conditions, the effect of any flexing of the handle section 10** upon the operation of the bow is negligible.

On the back face of the bow shown in FIG. 1 are provided a pair of stabilizers 26 and 28 spaced above and below a horizontal dot-dash line X—X through the center of gravity of the bow, which line will hereinafter be referred to as the transverse axis of the bow. A vertical dot-dash line Y—Y through the center of gravity of the bow is shown in the drawing also, which line will hereinafter be referred to as the longitudinal axis of the bow.

Figure 2:
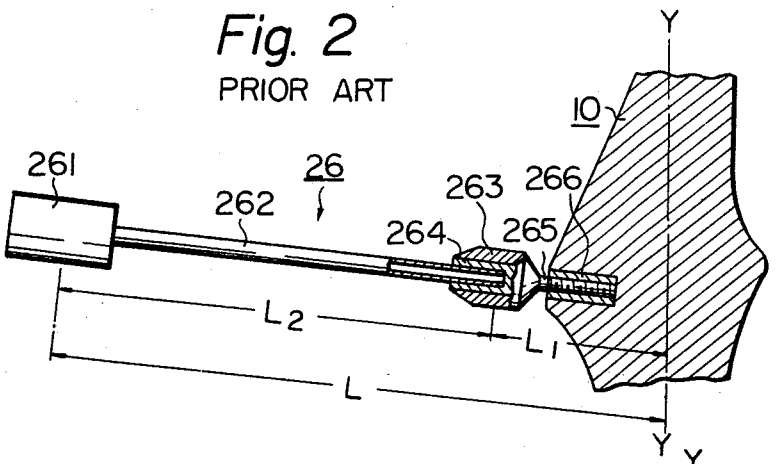
Fig. 2 PRIOR ART
FIG. 2 is a side elevational plan view, partly in section, of a stabilizer used in the archery bow shown in FIG. 2

Construction of one of the pair of stabilizers, i.e., the upper stabilizer 26 is shown in FIG. 2 in detail. However, it should be understood that the lower stabilizer 28 is provided with a substantially similar construction.

In the drawing, the stabilizer 26 comprises a weight element 261 disposed at one end of a support rod 262 which extends in a direction substantially normal to a tangent of the back face of the bow at a position whereat the stabilizer 26 is mounted to the handle section 10 of the bow. Thus, the axial direction of the support rod 262 is oblique to the longitudinal axis Y—Y of the bow. The other end of the support rod 262 is resiliently supported by a damper 263, via an intervening sleeve 264, made of an elastic material such as rubber. The damper 263 is provided with a threaded rod 265 which is screwed into a threaded sleeve 266 fully embedded in the back face of the handle section 10 of the bow.

In connection with this construction, it is assumed that L indicates the distance between the center of gravity of the weight element 261 and the longitudinal axis Y—Y of the bow along the axial direction of the support rod 262, $L_1$ indicates the distance between the center of gravity of the damper 263 and the longitudinal axis Y—Y along the same direction and $L_2$ indicates the distance between the centers of gravity of the weight element 261 and the damper 263. Here, it should be understood the substantial stabilizing effect of the stabilizer 26 is dependent upon the length of the distance $L_2$. That is, the longer the distance $L_2$, the larger the stabilizing effect of the stabilizer 26.

With the above-described construction of the conventional stabilizer, the mass moment of inertia by the weight element 261 about the longitudinal axis Y—Y of the bow is dependent upon the distance L whereas the mass moment of inertia by the damper 263 about the longitudinal axis Y—Y of the bow is dependent upon the distance $L_1$, the stabilizing effect by the stabilizer 26 being controlled by the distance $L_2$ as already explained.

In the conventional stabilizer shown in FIG. 2, the damper 263 is located outside the handle section 10 remote from the longitudinal axis Y—Y. This outside positioning of the damper 263 results in increased length of the distance $L_1$ and the longer distance $L_1$ naturally leads to a larger mass moment of inertia by the damper 263. Thus the total mass moment of inertia, i.e., the mass moment of inertia by the weight element 261 plus the mass moment of inertia by the damper 263, acting on the bow is increased and such increase in the total mass moment of inertia of the bow restrains the bow from delicate reaction thereof responsive to the initial behavior of the arrow at the very moment of release.

In order to afford constant mass moment of inertia about the longitudinal axis Y—Y of the bow, it is necessary to fix the distance L constant. When the distance $L_1$ is increased on this condition, i.e., the damper 263 is located outside the handle section 10 remote from the longitudinal axis Y—Y, the length of the distance $L_2$ should accordingly be decreased in order that the sum L of the two distances $L_1$ and $L_2$ remain constant. As already described, this reduced length of the distance $L_2$ leads to degraded stabilizing effect by the stabilizer.

Figure 3:
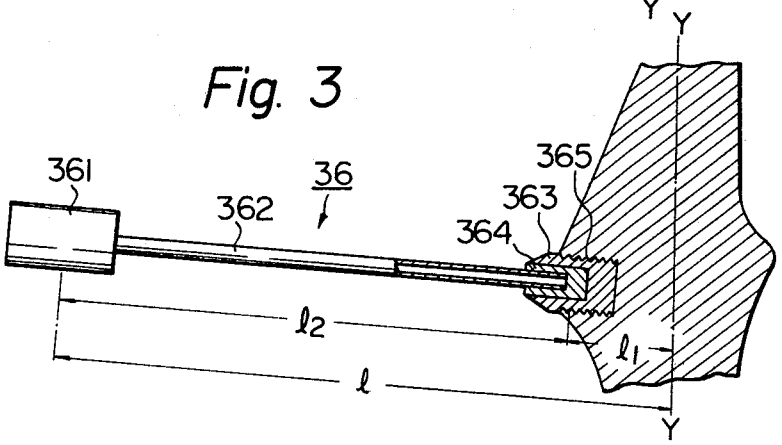
FIG. 3 is a side elevational plan view, partly in section, of a stabilizer in accordance with the present invention.

An embodiment of the present invention is shown in FIG. 3, in which an upper stabilizer 36 is shown. However, it should be understood that a lower stabilizer 38, which is not shown in the drawing, is provided with a substantially similar construction.

As with the conventional structure, the stabilizer 36 is comprised of weight element 361, a support rod 362 and a damper 363, the running direction of the support rod 362 being substantially similar to that of the support rod 262 of the conventional stabilizer 26 shown in FIG. 2. However, in accordance with the present invention, the damper 363 is partly or fully embedded within the body of the handle section 10. In the case of the illustrated embodiment, the damper 363 is partly embedded in the body of the handle section via screw engagement 365 and upholds the end of the support rod 362 via a sleeve 364 made of an elastic material such as rubber.

In connection with this construction, l indicates the distance between the center of gravity of the weight element 361 and the longitudinal axis Y—Y of the bow along the axial direction of the support rod 362, $l_1$ indicates the distance between the center of gravity of the damper 363 and the longitudinal axis Y—Y along the same direction and $l_2$ indicates the distance between the centers of gravity of the weight element 361 and the damper 363. Here, it should be understood the substantial stabilizing effect of the stabilizer 36 is dependent upon the length of the distance $l_2$. Thus, quite like the conventional stabilizer 26 shown in FIG. 2, the longer the distance $l_2$, the larger the stabilizing effect by the stabilizer 36.

With the above-described construction of the stabilizer in accordance with the present invention, the mass moment of inertia by the weight element 361 about the longitudinal axis Y—Y of the bow 10 is dependent upon the distance l whereas the mass moment of inertia by the damper 363 about the longitudinal axis Y—Y of the bow is dependent upon the distance $l_1$, the stabilizing effect by the stabilizer 36 being controlled by the distance $l_2$ as already described.

In the stabilizer in accordance with the present invention shown in FIG. 3, the damper 363 is positioned at least partly inside the body of the handle section 10 close to the longitudinal axis Y—Y. Therefore, the distance $l_1$ in FIG. 3 is shorter than the distance $L_1$ in FIG. 2. This shortened distance $l_1$ leads to reduced mass moment of inertia by the damper 363 about the longitudinal axis Y—Y, resulting in corresponding reduction in the total mass moment of inertia acting on the bow. Such reduced total mass moment of inertia acting on the bow enables the bow to present remarkably delicate reaction responsive to the initial behavior of the arrow at the very moment of release.

On the condition that the distance l in FIG. 3 is equal to the distance L in FIG. 2, the distance $l_2$ in FIG. 3 is apparently longer than the distance $L_2$ in FIG. 2 because, as already explained, the distance $l_1$ in FIG. 3 is shorter than the distance $L_1$ in FIG. 2. Thus the stabilizing effect by the stabilizer 36 in accordance with the present invention, which is dependent upon the distance $l_2$, is greater than that by the conventional stabilizer 26, which is dependent upon the distance $L_2$.

The delicate reaction of the bow resulting from the stabilizer construction in accordance with the present invention assures smooth passage of arrows through the sight window 24 of the bow and stabilization of the arrow shooting direction. Stabilizing effect is also remarkably improved. In addition, provision of the damper in the body of the handle section, which is made of a material different from that for the latter, effectively prevents transmission of vibration generated at the limbs to handle gripping portion.

Although the present invention has been described in connection with the preferred embodiment thereof, many variations and modifications will now become apparent to those skilled in the art. It is preferred, therefore, that the present invention be limited not by the specific disclosure herein, but only by the appended claims.

I claim:

1. Apparatus comprising:

an archery bow having a centrally located handle, said handle having an outer periphery;

a stabilizing weight element;

a damper at least partially embedded in said handle of said bow and having its center of gravity located adjacent the longitudinal axis of the bow and positioned within the boundary of said outer periphery of said handle at the immediately adjacent area of attachment of the damper to the handle, said damper including a recess therein;

a support rod supporting said stabilizing weight element on one end thereof, the remaining end of said support rod being located within said recess to said damper and an elastic sleeve located in said recess between the walls of the recess of said damper and said other end of said support rod and at least partially within the boundary of said outer periphery of said handle, said elastic sleeve adapted to resiliently couple said support rod to said damper in such a manner that said bow is permitted to follow minor oscillations in an arrow shot by said bow substantially independently of the stabilizing effect of said weight element.

2. The apparatus of claim 1 in which said damper is fully embedded within said boundary of said outer periphery of said handle.

3. The apparatus of claim 1 in which said damper is attached to said handle by a screw engagement.

4. The apparatus of claim 1 further comprising:

an additional stabilizing weight element;

an additional damper at least partially embedded in said handle of said bow and having its center of gravity located within the boundary of said outer periphery of said handle, said damper including a recess therein;

an additional support rod supporting said additional stabilizing weight element on one end thereof, the remaining end of said support rod being located within said recess of said damper;

an additional elastic sleeve located in said recess of said additional damper between the walls of said additional damper and said remaining end of said additional support rod and at least partially within the boundary of said outer periphery of said handle, said additional elastic sleeve adapted to resiliently couple said additional support rod to said additional damper whereby said bow is permitted to follow minor oscillations in an arrow shot by said bow substantially independently of the stabilizing effect of said additional weight element.

5. The apparatus of claim 4, wherein each of dampers are fully embedded within said boundary of said outer periphery of said handle.

6. The apparatus of claim 5 in which said dampers are each attached to said handle by a respective screw engagement.

7. The apparatus of claim 4, wherein the resiliently supporting means of each of said dampers includes an elastic sleeve embedded therein.

* * * * *